US005844373A

United States Patent [19]

Yao et al.

[11] Patent Number: 5,844,373

[45] Date of Patent: Dec. 1, 1998

[54] POWER SUPPLYING APPARATUS, A PLASMA DISPLAY UNIT, A METHOD OF CONVERTING A DIRECT-CURRENT VOLTAGE AND A METHOD OF ADDING TWO DIRECT-CURRENT VOLTAGES

[75] Inventors: Shinpei Yao; Shigeki Kameyama; Tomokatsu Kishi; Tetsuya Sakamoto, all of Kawasaki, Japan

[73] Assignee: Fujitsu Limited, Kanagawa, Japan

[21] Appl. No.: 914,229

[22] Filed: Aug. 19, 1997

Related U.S. Application Data

[63] Continuation of Ser. No. 624,775, Mar. 27, 1996, abandoned, which is a continuation of Ser. No. 181,536, Jan. 14, 1994, abandoned.

[30] Foreign Application Priority Data

May 25, 1993 [JP] Japan ..... 5-121793

[51] Int. Cl.[6] ..... H05B 37/00

[52] U.S. Cl. ..... 315/205; 315/169.4; 345/55

[58] Field of Search ..... 315/111.21, 231, 315/232, 238, 240, 243, 249, 307, 169.4, 205; 327/536, 537; 345/37, 41, 42, 211, 55

[56] References Cited

U.S. PATENT DOCUMENTS

| | | | |
|---|---|---|---|
| 4,263,534 | 4/1981 | Martin et al. . | |
| 4,716,341 | 12/1987 | Oida et al. . | |
| 4,841,556 | 6/1989 | Kato et al. | 315/111.21 |
| 5,039,921 | 8/1991 | Kakitani | 315/307 |
| 5,072,155 | 12/1991 | Sakorai et al. | 315/219 |
| 5,087,857 | 2/1992 | Ahn | 315/111.21 |
| 5,200,670 | 4/1993 | Scott | 315/111.21 |
| 5,293,077 | 3/1994 | Seki et al. | 315/307 |
| 5,331,252 | 7/1994 | Kim | 315/169.4 |

FOREIGN PATENT DOCUMENTS

| | | | |
|---|---|---|---|
| 0 334 644 | 3/1989 | European Pat. Off. . | |
| 0 461 717 | 6/1991 | European Pat. Off. . | |
| 0 519 882 | 6/1992 | European Pat. Off. . | |
| 41 19 806 | 6/1991 | France . | |
| 35 21 983 | 1/1987 | Germany . | |
| 37 14 175 | 11/1988 | Germany . | |
| 4272698 | 9/1992 | Japan | 315/240 |

OTHER PUBLICATIONS

C. D. Brock et al, "Push–pull capacitors multiply input voltage".

Patent Abstract of Japan, vol.12, No.85 (E–591), Mar. 17, 1988, & JP–A–62–221865, Sep. 29, 1987.

*Primary Examiner*—Benny Lee
*Assistant Examiner*—David H. Vu
*Attorney, Agent, or Firm*—Nikaido Marmelstein Murray & Oram, LLP

[57] ABSTRACT

A power supply which inputs a first direct-current voltage from the outside and outputs a high direct-current voltage to a plasma display panel. The power supply connects the input direct-current voltage to a positive polarity side of a first capacitor of a plurality of N capacitors connected in series to each other and connects a negative polarity side of the first capacitor to a ground (step 1); connects the input direct-current voltage to a positive polarity side of an Mth capacitor of the N capacitors and connects a negative polarity side of the Mth capacitor to the ground (step 2); repeats step 2 for M=2 to N (step 3); and outputs a voltage of the positive polarity side of the first capacitor to the plasma display panel (step 4).

22 Claims, 10 Drawing Sheets

POWER SUPPLYING APPARATUS, A PLASMA DISPLAY UNIT, A METHOD OF CONVERTING A DIRECT-CURRENT VOLTAGE AND A METHOD OF ADDING TWO DIRECT-CURRENT VOLTAGES

This application is a continuation of prior application Ser. No. 08/624,775 filed on Mar. 27, 1996, now abandoned which is a continuation of parent application Ser. No. 08/181,536 filed on Jan. 14, 1194 now abandoned.

BACKGROUND OF THE INVENTION

1. Field of the Invention

The present invention relates to a power supplying apparatus used for a plasma display unit, and more particularly to a power supplying apparatus used for a color-type plasma display panel.

A plasma display unit displays an image on a plasma display panel by utilizing a phenomenon that an electrical discharge in a inert gas causes a luminescence. The plasma display unit is widely used as a display board for notification and advertisement and as a display panel for a portable computer, for example, because it can realize quite a large screen size considering that it is a plane type and it can display images on the screen at high density. A color-type plasma display unit usually uses a surface discharge-type panel. However, a power unit for supplying power to the surface-discharge type panel tends to be large-sized and expensive, and so does the color-type plasma display unit, because the panel requires a plurality of power-supply voltages.

As use of a plasma display unit has become widespread in recent years, demand for a plasma display unit which is small-sized and economical has increased. To meet this demand, a power unit for a color-type plasma display panel of the plasma display unit, which is also small-sized, energy-efficient and low-priced is also increasing.

2. Description of the Related Art

FIG. 1 shows a configuration of a plasma display panel. FIG. 2 illustrates a configuration of electrodes of a plasma display panel.

A color-type plasma display unit usually uses a surface discharge-type panel (hereinafter simply called a display panel). As shown in FIG. 1, between a front glass substrate and a rear glass substrate, the surface discharge-type display panel places fluorescent materials which emit light when excited by ultraviolet rays, various types of electrodes, partitions, a dielectric layer and a protection layer. Display electrodes and data electrodes are provided on the front glass substrate and the rear glass substrate, respectively. The display electrodes are comprised of discharge sustaining electrodes (e.g., X1, X2–X7 in FIG. 2, hereinafter simply called sustaining electrodes) and discharge scanning electrodes (e.g., Y1, Y2–Y7, hereinafter simply called scanning electrodes).

As the scanning electrodes are scanned (i.e., a voltage is applied sequentially to each of the scanning electrodes) with a voltage applied to the sustaining electrodes, lines on the display screen are selected one by one. Three data electrodes (e.g., A1, A2 and A3 in FIG. 2) correspond to three primary colors of light, i.e., red (R), green (G) and blue (B). Thus, three points (R, G, B) where the 3 data electrodes intersect the line which is selected by the sustaining electrodes and the scanning electrodes, compose a picture element (hereinafter called pixel) on the display screen.

Based on data to be displayed on the panel, a voltage Va (approx. 50 volts) required for starting a discharge is applied to the data electrodes and a voltage Vs (approx. 180 volts) required for maintaining the discharge is applied to the sustaining electrodes and scanning electrodes. A high voltage Vd (approx. 330 volts) is applied to the sustaining electrodes to start a discharge over the entire surface of the display panel (hereinafter this discharge operation is called entire-surface discharge). Accordingly, the display panel requires a data-selection voltage Va (approx. 50 volts) and an entire-surface-discharge-starting voltage Vd (approx. 330 volts) in addition to a discharge-sustaining voltage Vs (approx. 180 volts).

FIG. 3 is a circuit diagram of a power unit of the related art. Parts (a) and (b) of FIG. 3 show portions of the power unit for generating the voltage Vd and the voltage Va, respectively.

FIG. 3 part (b) shows a known switching regulator circuit using a pulse-width modulation (PWM) control integrated circuit (abbreviated to PWM-control IC). The switching regulator circuit turns on and off a transistor T9 with the PWM-control IC to pulse-width modulate a power supply voltage Vs (approx. 180 volts) input thereto. The circuit then rectifies and smooths the pulse voltage output from the transistor T9 with a choke coil L and a capacitor C to output a voltage Va (approx. 50 volts).

In FIG. 3 part (a), when a transistor T8 is turned on by a PWM-control IC, electric energy is accumulated in the a choke coil L. When the transistor T8 is turned off, the electric energy accumulated in the choke coil L is released and added to the power supply voltage Vs, generating the high voltage Vd (approx. 330 volts).

As described above, the power unit of the related art uses two separate and similar switching regulator circuits including the PWM-control ICs and choke coils L, to generate the voltages Vd and Va required for controlling the display panel.

Therefore, it is a problem of the power unit of the related art that the power unit, i.e., the plasma display unit is large-sized, expensive and power-consuming since it uses electronic parts such as PWM-control ICs and choke coils.

SUMMARY OF THE INVENTION

It is an object of the present invention to provide a small-sized and economical power unit used for a color-type plasma display panel.

To achieve the above and other objects, the present invention provides a voltage-booster circuit in a power supplying apparatus for a plasma display panel.

In a power supplying apparatus which inputs a first direct-current voltage from an external power supply and outputs a second direct-current voltage to a plasma display panel, the voltage-booster circuit converts a direct-current voltage input thereto directly into a higher direct-current voltage.

BRIEF DESCRIPTION OF THE DRAWINGS

Throughout the above-mentioned drawings, identical reference numerals are used to designate the same or similar component parts.

DESCRIPTION OF THE PREFERRED EMBODIMENTS

Figure 4:
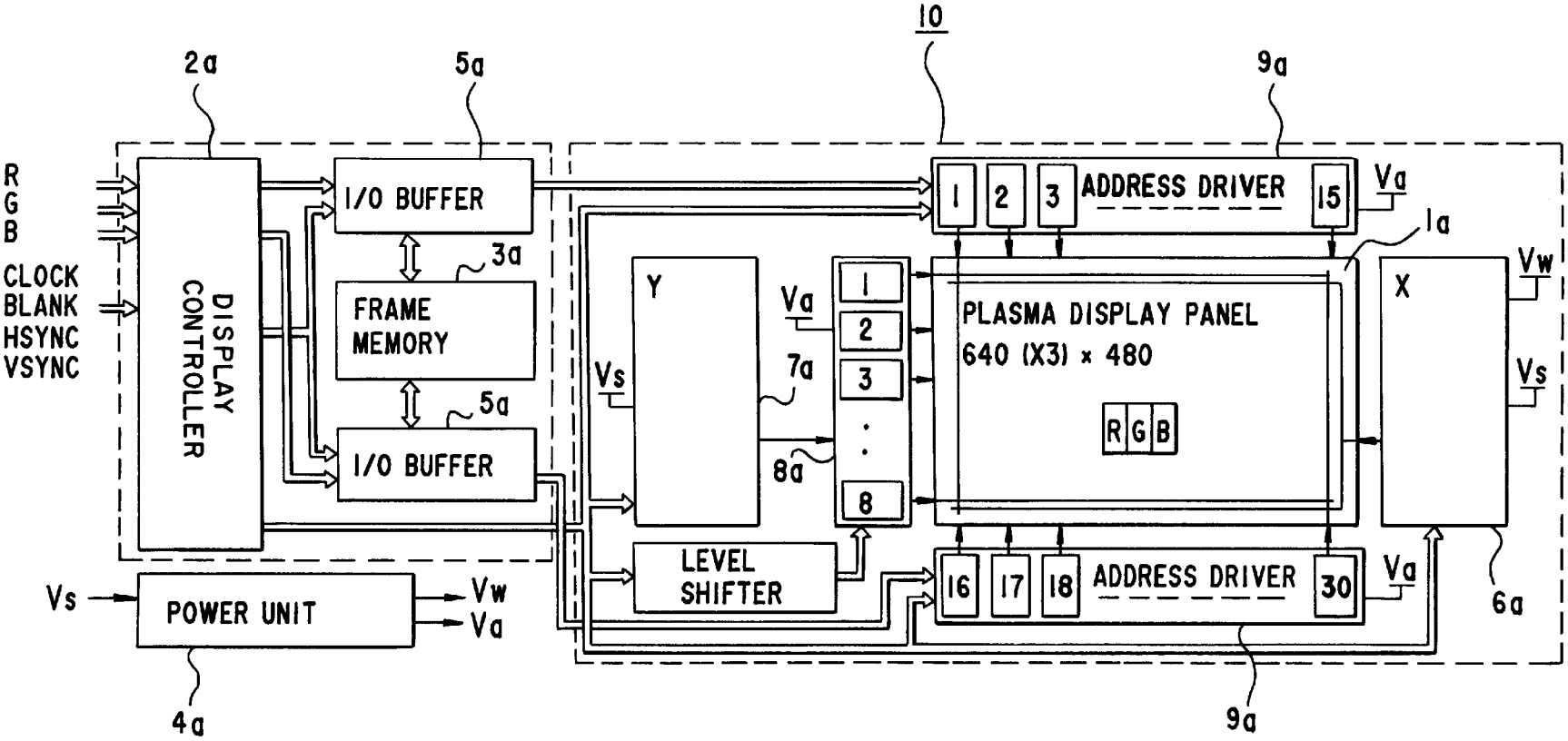
FIG. 4 is a block diagram illustrating a plasma display unit for practicing the present invention.

FIG. 4 is a block diagram illustrating a plasma display unit for practicing the present invention.

Unlike the power unit of the related art which uses a switching regulator to generate the entire-surface discharge-starting voltage Vd (approx. 330 volts), the present invention generates a voltage Vw (approx. 150 volts) first with a voltage-booster circuit and then adds the voltage Vw to the voltage Vs (approx. 180 volts) with a voltage-adder circuit 4*b* (see FIG. 10), thus generating the voltage Vd.

Figure 1:
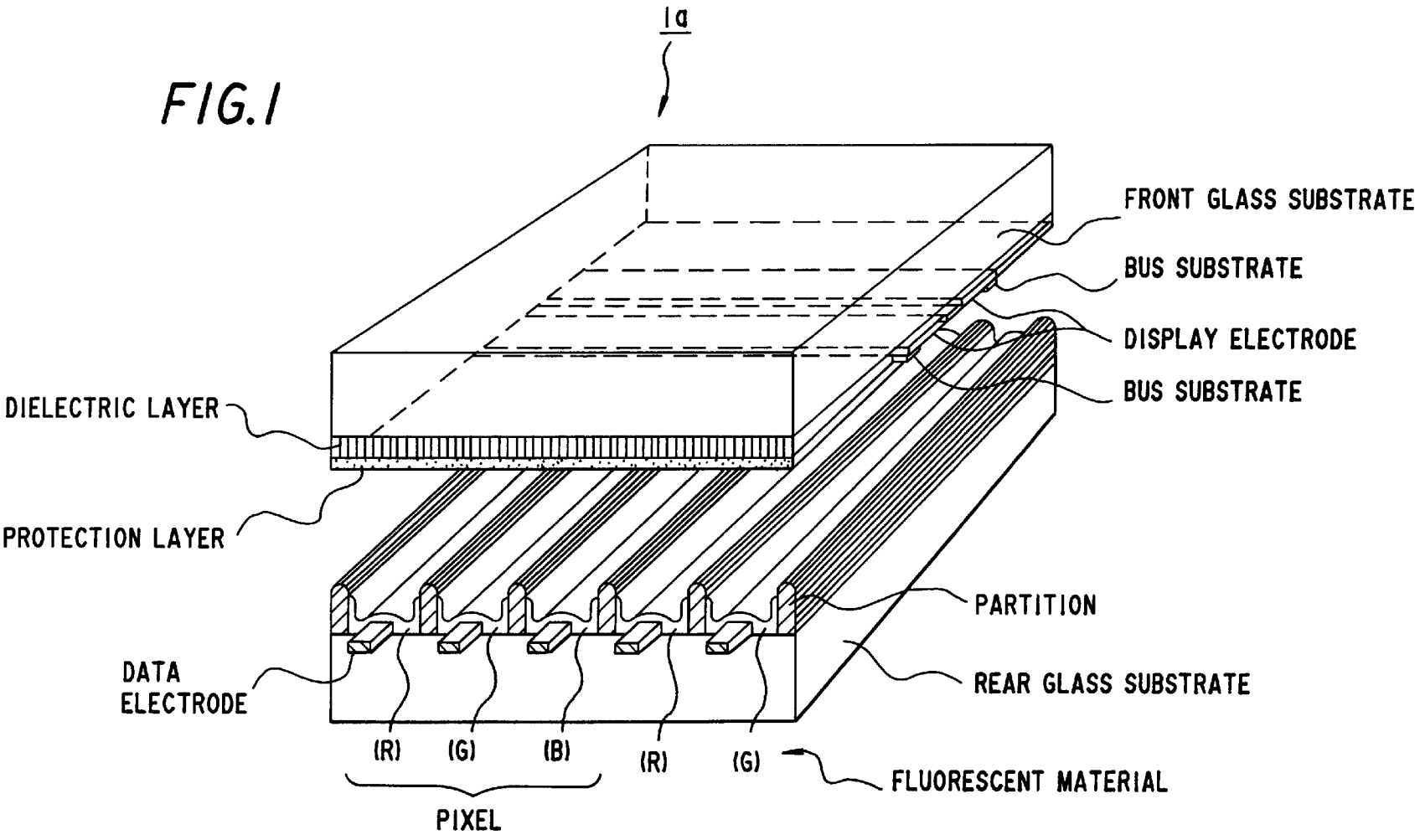
FIG. 1 shows a configuration of a plasma display panel.
Figure 2:
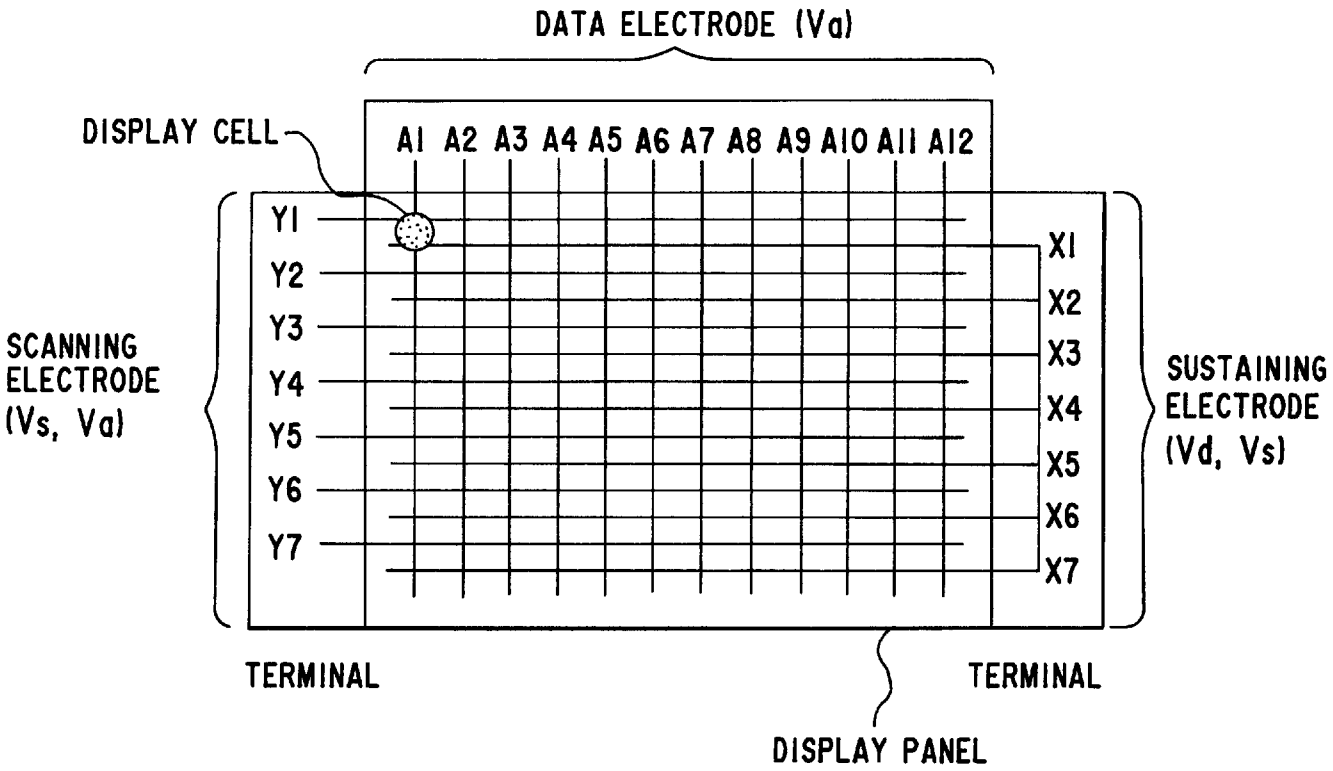
FIG. 2 illustrates a configuration of electrodes of a plasma display panel.
Figure 3:
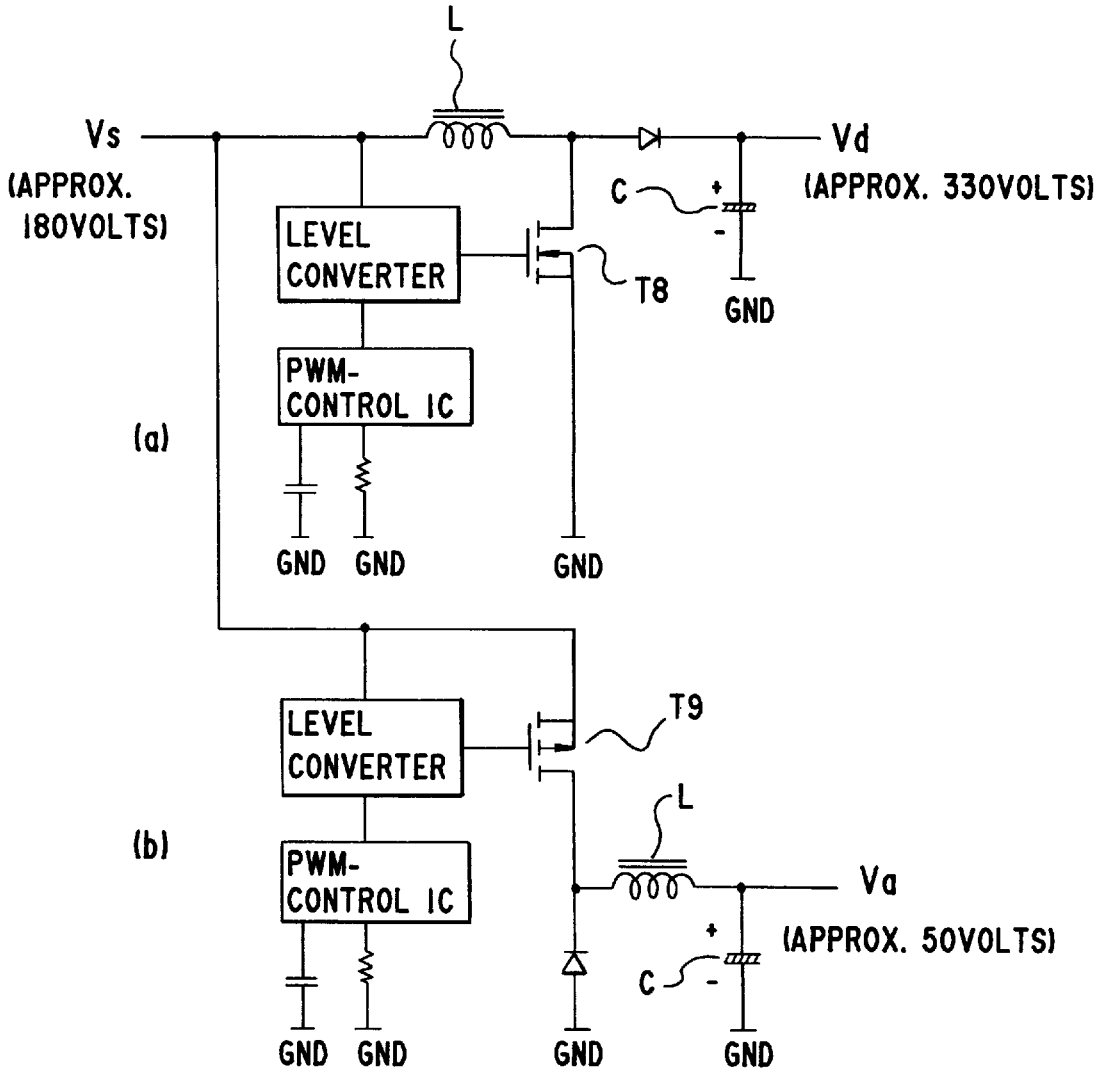
FIG.3 PRIOR ART
FIG. 3 is a circuit diagram of a power unit of the related art.

A display panel 1*a,* which is constructed as shown in FIGS. 1 and 2, has 480 pixels wide×640 pixels long, for example, each pixel having three display cells which correspond to three primary colors (R, G, B) of light.

A display controller 2*a* controls the display panel 1*a* based upon control signals input from an external device (not shown). The display controller 2*a* inputs display data including R, G and B signals for each pixel and stores the display data sequentially into a frame memory 3*a* via a pair of input-output (abbreviated to I/O) buffers 5*a*. The R, G and B signals each consist of a plurality of bits to express a pixel of an image in a plurality of scales. The display controller 2*a* also generates timing signals for controlling the plasma display panel 1*a* based upon a clock signal (CLOCK), blanking signal (BLANK), horizontal synchronizing signal (HSYNC) and vertical synchronizing signal (VSYNC), which are input from the external device, and sends the timing signals to circuit blocks of the display unit.

A power supply 4*a,* to which the present invention relates, is supplied with the power supply voltage Vs from the external device, generates the voltages Vw and Va required for controlling the display panel 1*a*, and supplies the voltages to a drive circuit 10.

The frame memory 3*a*, which is a bit-map memory composed of dynamic random access memory (DRAM), stores the display data input from the external device via the display controller 2*a*. The frame memory 3*a* stores display data consisting of R, G and B signals for each pixel, each of which signals include a plurality of bits to express a pixel of an image in a plurality of scales.

The input-output (abbreviated to I/O) buffers 5*a* temporarily store the display data read from the frame memory 3*a* and output the data to corresponding address drivers 9*a* to display the display data on the display panel 1*a*.

Figure 5:
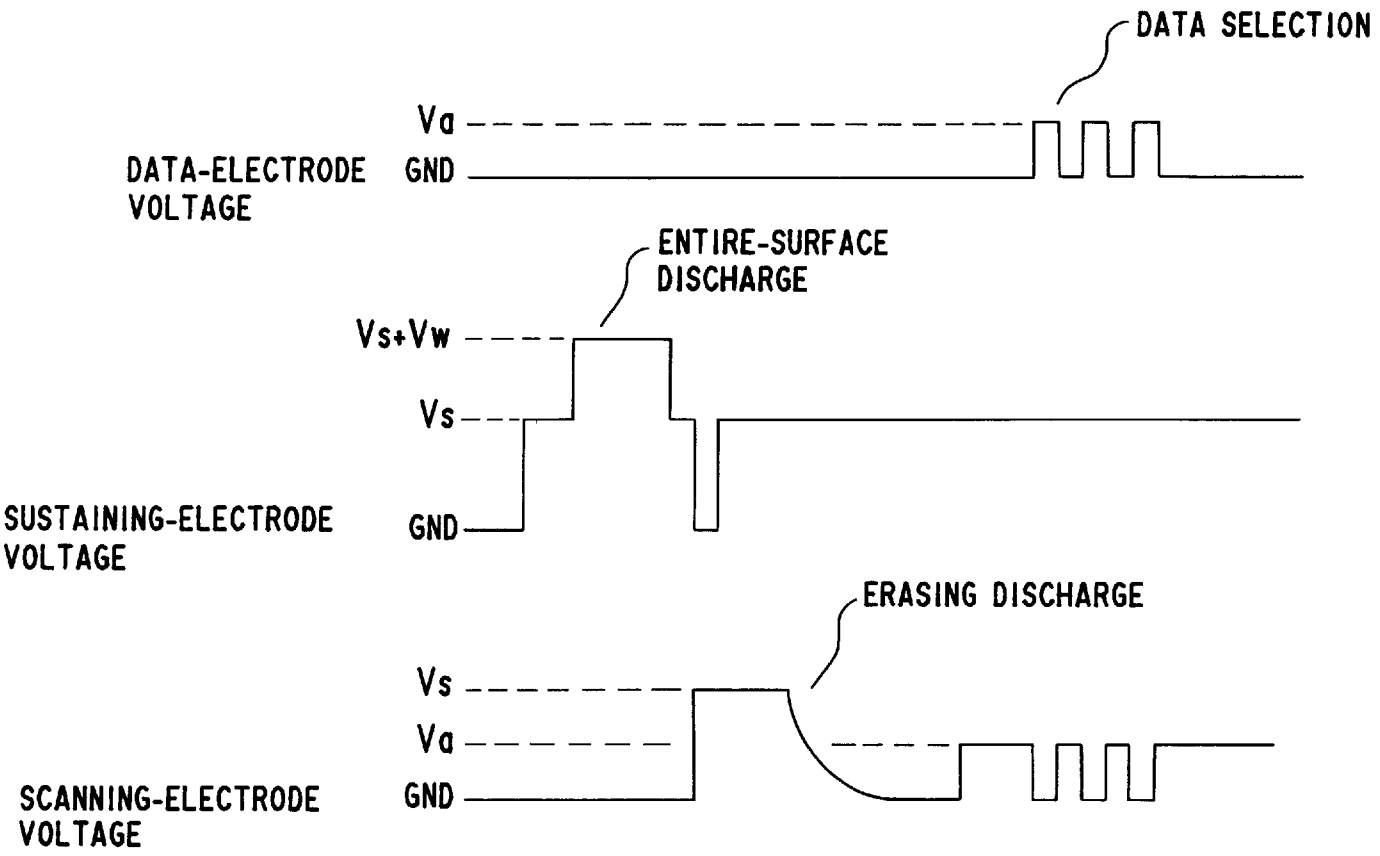
FIG. 5 is a timing chart illustrating control of a display panel.

A sustaining-pulse generator circuit 6*a* is supplied with the power-supply voltages Vw and Vs, generates pulses having a waveform as shown in "Sustaining-electrode voltage" in FIG. 5 and supplies the pulses to the sustaining electrodes. At the entire-surface discharge cycle, the sustaining-pulse generator circuit 6*a* adds the voltage Vw to the voltage Vs (see FIG. 10) and supplies the added voltage (approx. 330 volts) to the sustaining electrodes.

A scanning-pulse generator circuit 7*a* is supplied with the power-supply voltage Vs, generates a pulse having a waveform of amplitude Vs as shown in "Scanning-electrode voltage" in FIG. 5 and supplies the pulse to a scanning driver circuit 8*a*.

The scanning driver circuit 8*a,* which is supplied with the above-mentioned pulse from the scanning-pulse generator circuit 7*a* and the power-supply voltage Va from the power unit 4*a*, generates pulses having a waveform as shown in "Scanning-electrode voltage" in FIG. 5 and supplies the pulses to the scanning electrodes.

The address driver circuits 9*a*, based upon the display data input from the corresponding I/O buffers, generate pulses having a waveform of amplitude Vs as shown in "Data-electrode voltage" in FIG. 5 and supplies the pulses to the data electrodes.

FIG. 5 is a timing chart illustrating control of a display panel.

An image is displayed on the display panel 1*a* by sequentially executing an entire-surface discharge, erasing discharge and data display cycles for each frame of an image (hereinafter simply called frame).

Prior to displaying a frame, the entire-surface discharge cycle is executed. In the cycle, the voltage Vw (approx. 150 volts) is added to the discharge-maintaining voltage Vs (approx. 180 volts) to generate a high voltage Vd (approx. 330 volts). The high voltage Vd is applied to the sustaining electrodes, which are provided in common to all the lines of the display screen, to cause a discharge over the entire surface of the display panel. When the entire-surface discharge is caused, wall charge is formed on the sustaining electrode side.

In the erasing discharge cycle, the entire-surface discharge is halted and the wall charge is left on the sustaining electrode side to facilitate a discharge just by applying a low voltage to the data electrodes in the data display cycle that follows. That is, after the high voltage Vd is applied to the sustaining electrodes in the entire-surface discharge cycle, a ground (GND) is applied to the sustaining electrodes for a short period and the voltage Vs is applied to the scanning electrodes in the erasing discharge cycle. Thus, in the erasing discharge cycle, a reverse electric field is provided between the sustaining and scanning electrodes, halting the discharge and leaving wall charge on the sustaining electrode side.

In the data display cycle, when a GND is applied sequentially to the scanning electrodes, lines are scanned and selected one after another and when the data electrodes are driven according to display data to be displayed on the line, the display cells on the selected line are caused to discharge and display the display data. Driving the data electrodes is conducted by reading the display data for each display cell from the I/O buffers 5*a* and, depending on the display data bit being logical 1 or 0, by applying the voltage Va or GND to the data electrodes which correspond to the display cell, thus causing the display cell to discharge or not to discharge.

Figure 6:
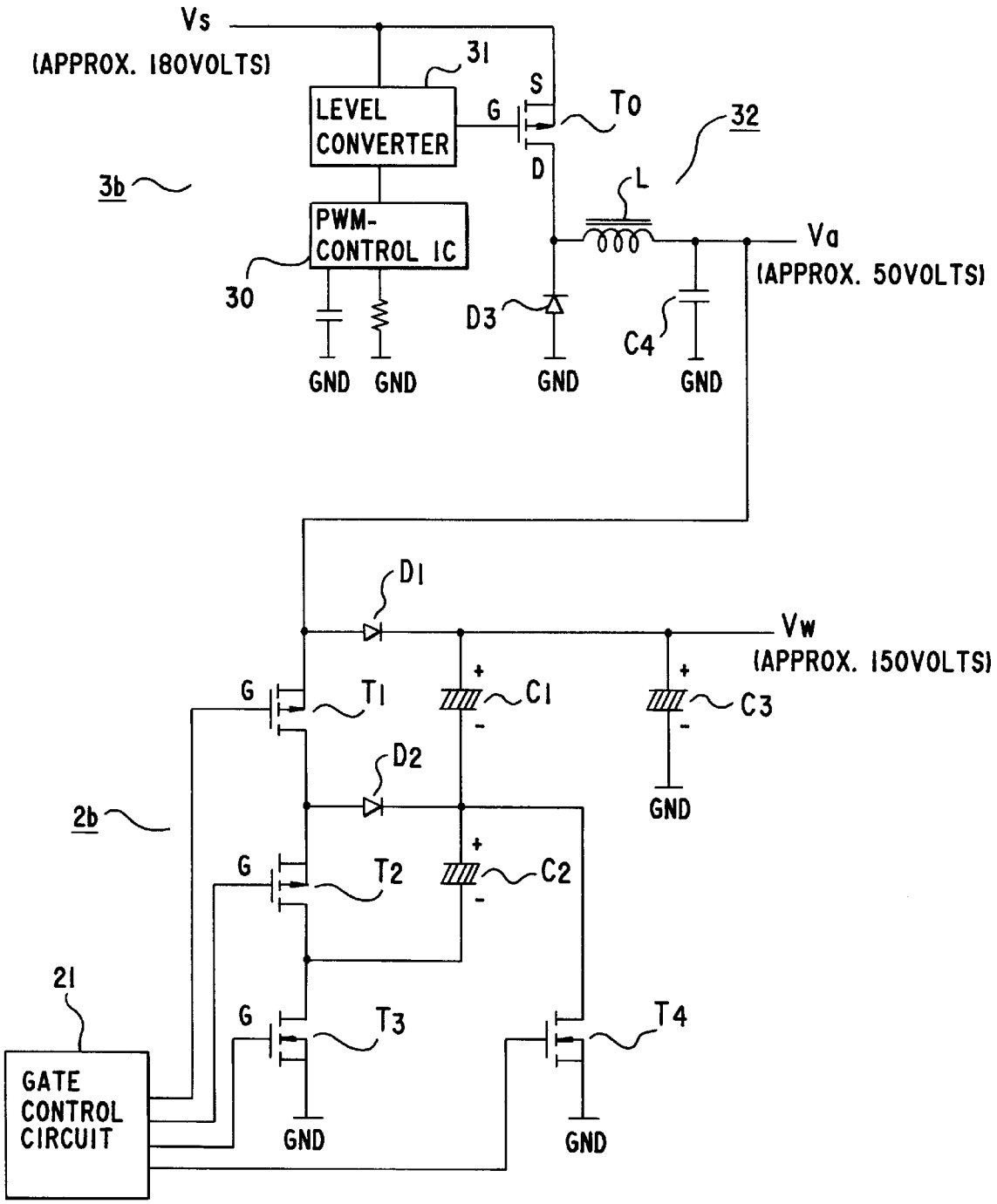
FIG. 6 is a circuit diagram of a power unit of the present invention.

FIG. 6 is a circuit diagram of a power unit of the present invention. The above-mentioned power unit 4*a* (see FIG. 4) includes a voltage regulator 3*b* and a voltage-booster circuit 2*b*.

The voltage regulator 3*b* inputs a power supply voltage Vs and outputs a stabilized voltage Va. The voltage regulator 3*b* turns on and off a transistor T0 with a pulse-width modulation (PWM)-control integrated circuit (abbreviated to PWM-control IC) and rectifies and smooths the pulse voltage output from the transistor T0 with a stabilizer circuit 32 to output the voltage Va.

The PWM-control IC 30 is a known circuit (e.g., Fujitsu-made MB3775), which compares the voltage Va output from the stabilizer circuit 32 with a reference voltage generated within the PWM-control IC 30 and, based on an error, controls a period in which the transistor T0 is turned on. When the output voltage Va is higher than the reference voltage, the PWM-control IC 30 shortens the period to lower the output voltage Va; otherwise, lengthens the period to raise the output voltage Va, thus regulating the power supply voltage Va despite variations in load.

A voltage converter circuit 31 converts the output voltage of PWM-control IC 30 into a voltage for driving the gate (G) of the transistor T0.

When the transistor T0 of the stabilizer circuit 32 is turned on, a current flows through the transistor T0, a choke coil L and a load (not shown), and electric energy is accumulated in the choke coil L. When the transistor T0 is turned off, the energy accumulated in the coil L is released as a current through the load and a diode D3. The above operation is repeated in the period in which the transistor T0 is turned on and off, and steady and smooth direct-current voltage Va (approx. 50 volts) is via a capacitor C4.

The voltage-booster circuit 2*b* is comprised of capacitors C1, C2 and C3, p-channel field-effect transistors (FET) T1 and T2, n-channel field-effect transistors T3 and T4, reverse-current preventing diodes D1 and D2 and a gate control circuit 21. The voltage-booster circuit 2*b* is supplied with the voltage Va from the voltage regulator 3*b* and increases the voltage Va three times, i.e., steps up to a voltage Vw (approx. 150 volts).

Figure 7:
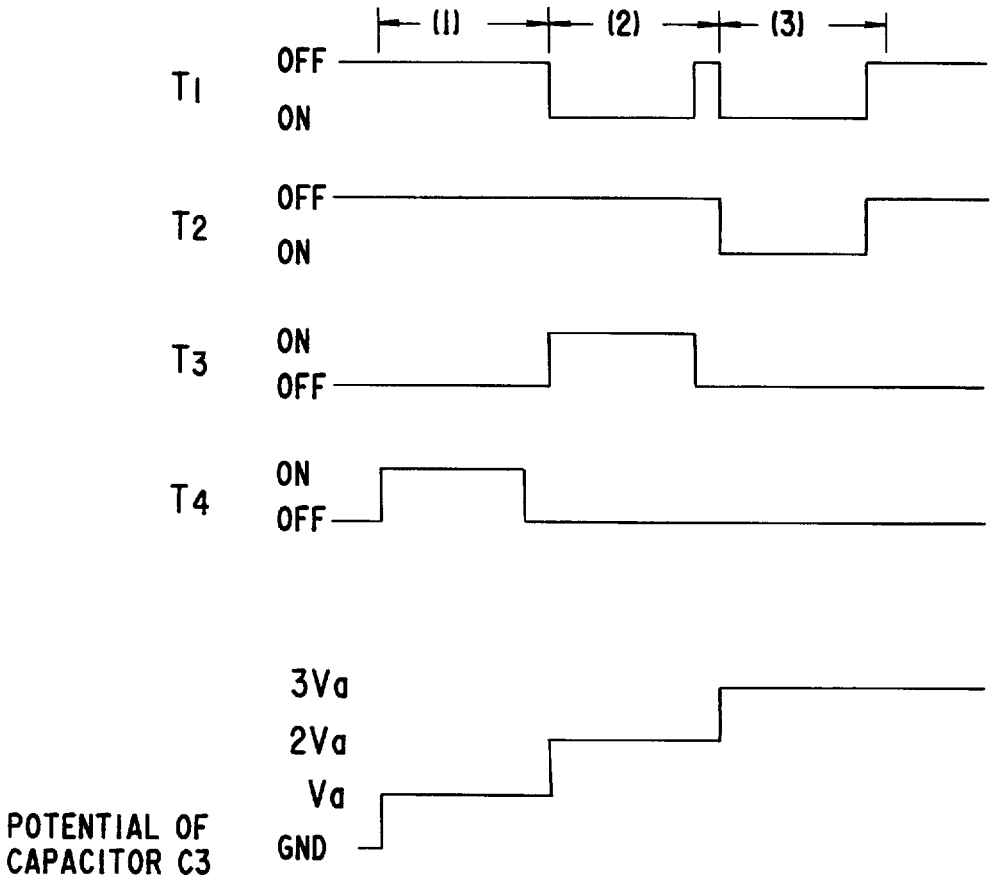
FIG. 7 is a timing chart illustrating an operation of a voltage-booster circuit of the present invention.
Figure 9:
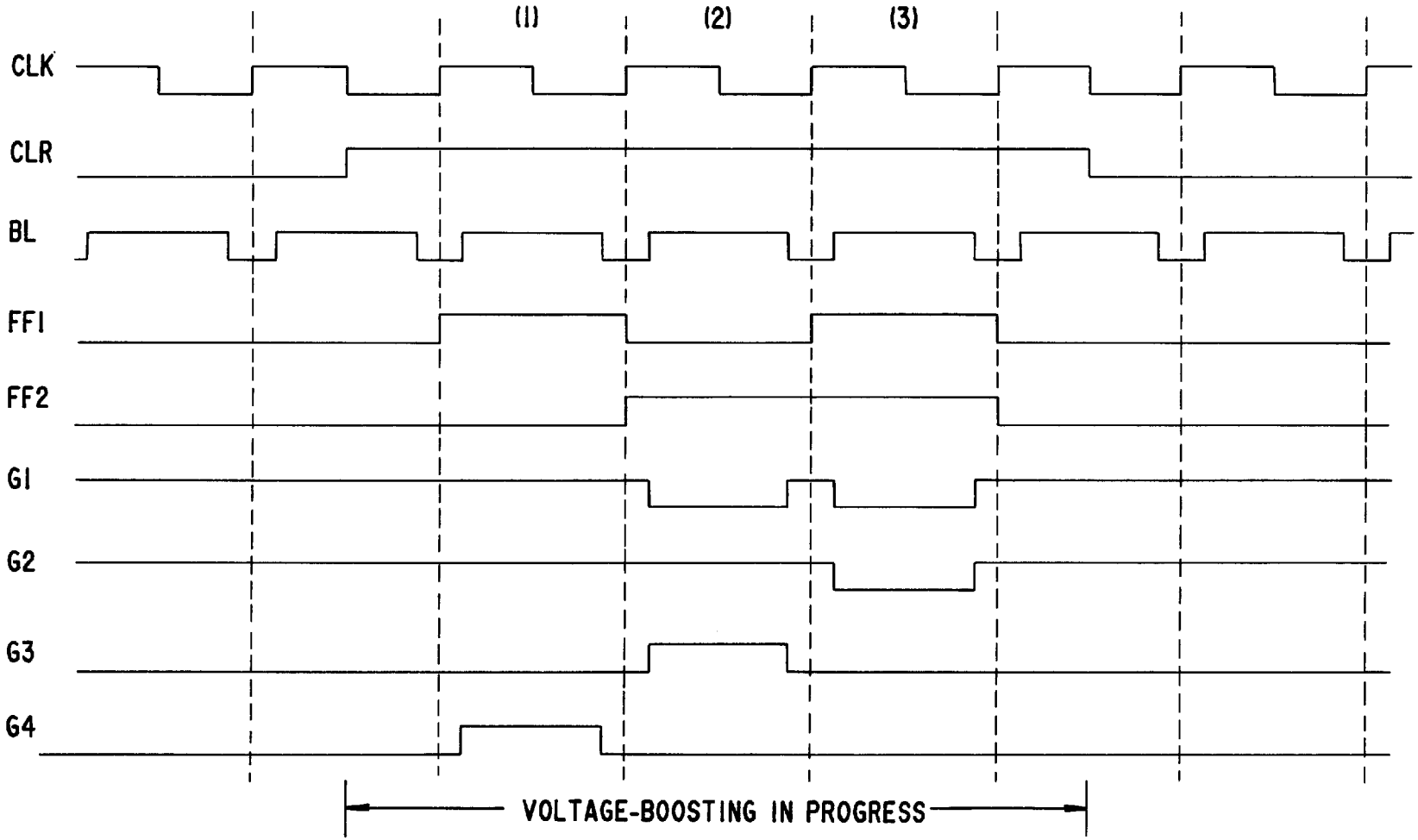
FIG. 9 is a timing chart illustrating an operation of the gate control circuit 21.

The gate control circuit 21 turns on and off transistors T1–T4 by providing their gates (G) with signals G1–G4 as shown in FIG. 9 to control the voltage-booster circuit 2*b*. Thus, the voltage-booster circuit 2*b* sequentially increases or steps up the input voltage Va as shown in FIG. 7, which is a timing chart illustrating an operation of a voltage-booster circuit of the present invention.

(1) First, in an initial state with the transistors T1–T4 turned off, the gate control circuit 21 turns on the transistor T4 only. Then, a current flows from the power supply Va (i.e., the output of the voltage regulator 3*b*) to the GND through the capacitor C1 and transistor T4, while charging the capacitors C1 and C3 and providing a voltage Va to their positive polarity sides.

(2) Next, the gate control circuit 21 turns off the transistor T4 and turns on the transistors T1 and T3 with the transistor T2 left turned off. Then, a current flows from the power supply Va to the GND through the transistor T1, capacitor C2 and transistor T3, while charging the capacitor C2 and providing a voltage Va to its positive polarity side. Thus, the positive polarity sides of the capacitors C1 and C3 are raised by another voltage Va, eventually to a potential of voltage 2Va.

(3) Finally, the gate control circuit 21 turns off the transistor T3 and turns on the transistor T2, i.e., turns on the transistors T1 and T2. Then, the potential of the negative polarity side of the capacitor C2 is raised to the voltage Va and therefore, the potential of both capacitors C1 and C2 is further raised by the voltage Va, eventually raising the potential Vw of the positive polarity sides of capacitors C1 and C3 to 3 Va (50 volts×3=150 volts).

Figure 8:
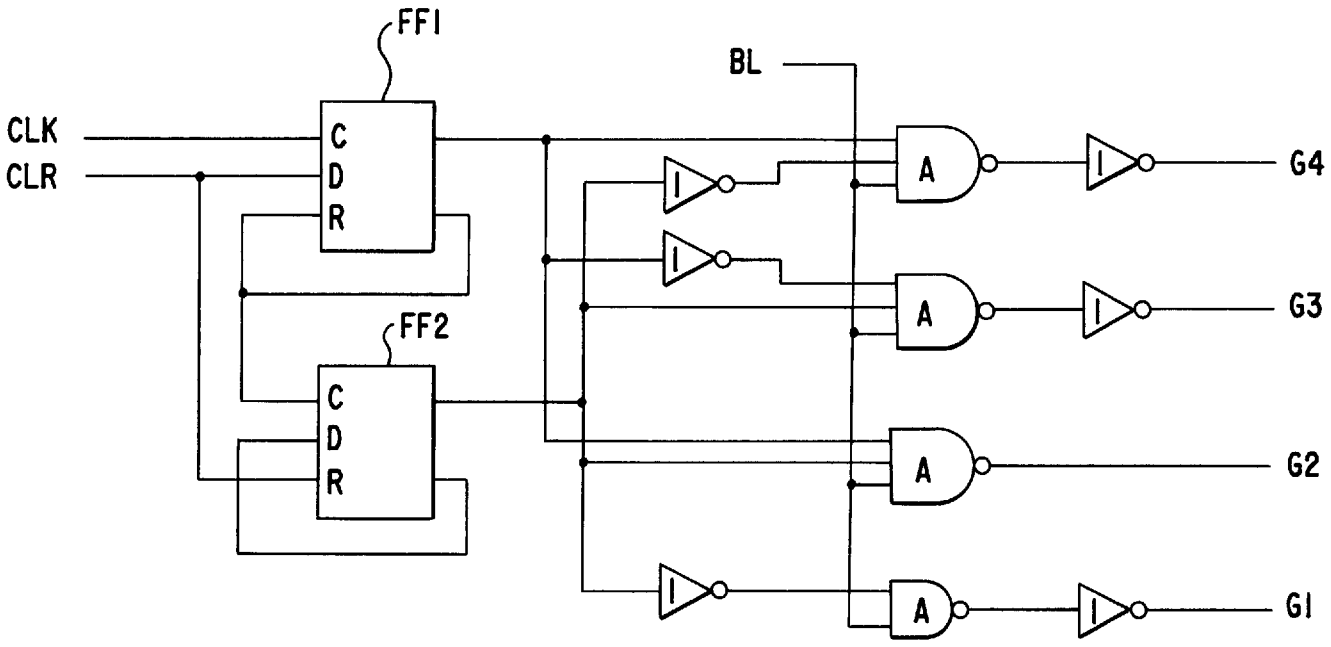
FIG. 8 is a circuit diagram of a gate control circuit 21 of the present invention.

FIG. 8 is a circuit diagram of a gate control circuit 21 of the present invention. FIG. 9 is a timing chart illustrating an operation of the gate control circuit 21.

Flip-flops FF1 and FF2 constitute a counter and count up an incoming clock (CLK) signal when a clear (CLR) signal is high. The CLR signal goes high when voltage-boosting is required for entire-surface discharge, and stays low unless required including when power-on reset is performed. The flip-flop outputs, their negations through inverters (represented by I in FIG. 8) and a blocking (BL) signal are input to NAND gates (represented by A) to decode the count and thereby to generate the G1–G4 signals. The BL signal prevents undesired combinations of the transistors T1–T4 turning on which may occur at a transition of switching. The inverters connected to the NAND-gate outputs provide the G1–G4 signals with a low or high level according to the corresponding transistors T1–T4 being p- or n-channel FET, in order to turn them on.

Figure 10:
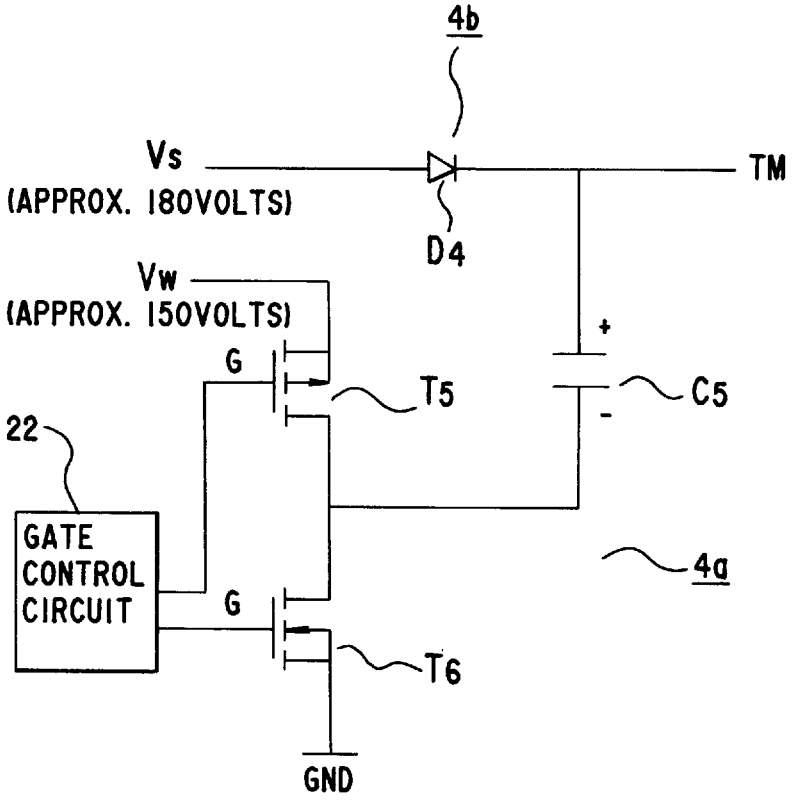
FIG. 10 is a circuit diagram of a voltage-adder circuit of the present invention.

FIG. 10 is a circuit diagram of a voltage-adder circuit of the present invention.

A voltage-adder circuit 4*b*, which is provided in the sustaining-pulse generator circuit 6*a* (see FIG. 4), is comprised of a transistor T5 (p-channel FET), a transistor T6 (n-channel FET), a capacitor C5, a reverse-current-preventing diode D4, and a gate control circuit 22. The voltage-adder circuit 4*b* is supplied with the voltages Vs (approx. 180 volts) and Vw (approx. 150 volts) from the voltage regulator 3*b* and voltage-booster circuit 2*b* (see FIG. 6), respectively, adds the voltage Vw to the voltage Vs to generate a high voltage Vd of approx. 330 volts and supplies the high voltage Vd to the sustaining electrodes at the entire-surface discharge cycle.

The gate control circuit 22 turns on and off the transistors T5 and T6 by controlling their gates (G) to add the voltage Vw to the voltage Vs at the entire-surface discharge cycle. In the data display cycle, the gate control circuit 22 turns off the transistor T5 and turns on the transistor T6 by applying a high level to both of their gates (G), thus providing a ground level (GND) to the negative polarity side of the capacitor C5. Therefore, the capacitor C5 is charged to the voltage Vs and the voltage Vs is output from a terminal TM.

In the entire-surface discharge cycle, the gate control circuit 22 turns on the transistor T5 and turns off the transistor T6 by applying a low level to both of their gates (G), thus providing the voltage Vw to the negative polarity side of the capacitor C5. Therefore, the positive polarity side of capacitor C5 is raised by a voltage Vw and thus, a voltage Vs+Vw, i.e., the voltage Vd is output from the terminal TM.

As described above, prior to displaying a frame, a high voltage Vd of approx. 330 volts is supplied to the sustaining-electrodes to start an entire-surface discharge. The high voltage Vd is generated first by boosting the voltage Va to the voltage Vw and then by adding the voltage Vs to the voltage Vw. Assuming that 60 frames are displayed per second, the high voltage Vd, i.e. the voltage Vw need be generated only once per 16.7 milliseconds and only for a period of 10–20 micro-seconds. Accordingly, the voltage-booster circuit 2*b* and voltage-adder circuit 4*b* can be composed of a smaller amount of electronic parts including transistors, logical elements and capacitors of small capacitance which are smaller-sized and more economical, compared with such electronic parts as a PWM-control IC and choke coil used in the related art. Thus, the present invention can realize a power unit for a plasma display panel, and therefore a plasma display unit which is small-sized and economical.

What is claimed is:

1. A power supplying apparatus which inputs a first direct-current voltage from an external power supply and outputs a second direct-current voltage to a plasma display panel, said power supplying apparatus comprising:

a voltage-booster circuit for inputting an input direct-current voltage derived from the first direct-current voltage and for boosting the input direct-current voltage to a third direct-current voltage; and a voltage-adder circuit for adding the third direct-current voltage to the first direct-current voltage and for outputting the second direct-current voltage.

2. A power supplying apparatus according to claim 1, wherein said power supplying apparatus further comprises a voltage regulator circuit for inputting the first direct-current voltage and converting the voltage into the input direct-current voltage, and wherein said voltage-booster circuit inputs the input direct-current voltage and converts the voltage into the third direct-current voltage.

3. A power supplying apparatus according to claim 2, wherein the plasma display panel makes a display by performing a write operation including an entire-surface discharge cycle, an erasing discharge cycle and data display cycle for each display frame; and wherein the second direct-current voltage causes a discharge over an entire surface of the plasma display panel in the entire-surface discharge cycle.

4. A power supplying apparatus according to claim 1, wherein said voltage-booster circuit comprises:

a capacitor; and a switching device for switching connections through which the voltage input to said voltage-booster circuit is applied to said capacitor so that a potential of said capacitor is increased; and wherein said voltage-adder circuit comprises:

a capacitor; and a switching device for switching connections so that one of the first and third direct-current voltages is applied to a positive polarity side of said capacitor and the other is applied to a negative polarity side of said capacitor.

5. A power supplying apparatus according to claim 4, wherein the plasma display panel makes a display by performing a write operation including an entire-surface discharge cycle, an erasing discharge cycle and data display cycle for each display frame; and wherein the second direct-current voltage causes a discharge over an entire surface of the plasma display panel in the entire-surface discharge cycle.

6. A power supplying apparatus according to claim 1, wherein said voltage-booster circuit comprises:

a plurality of capacitors connected in series to each other; and a plurality of switching devices for switching connections through which the voltage input to said voltage-booster circuit is applied to each of a plurality of said capacitors so that a potential of each of a plurality of said capacitors is sequentially increased.

7. A power supplying apparatus according to claim 1, wherein the plasma display panel includes a discharge-sustaining electrode, scanning electrode and data electrode, and wherein the second direct-current voltage is supplied to the discharge-sustaining electrode to cause a discharge over an entire surface of the plasma display panel, the input direct-current voltage is supplied to the data electrode and scanning electrode to cause a discharge based on data to be displayed, and the first direct-current voltage is supplied to the discharge-sustaining electrode and scanning electrode to sustain the discharge caused by the input direct-current voltage.

8. A power supplying apparatus according to claim 1, wherein the plasma display panel makes a display by performing a write operation including an entire-surface discharge cycle, an erasing discharge cycle and data display cycle for each display frame; and wherein the second direct-current voltage causes a discharge over an entire surface of the plasma display panel in the entire-surface discharge cycle.

9. A power supplying apparatus according to claim 1, wherein said voltage-adder circuit adds said voltage during a discharge cycle in which a discharge is caused over an entire surface of the plasma display panel.

10. A plasma display unit having a plasma display panel and a power supplying apparatus which inputs a first direct-current voltage from an external power supply and outputs a second direct-current voltage to the plasma display panel, said power supplying apparatus comprising:

a voltage-booster circuit for inputting an input direct-current voltage derived from the first direct-current voltage and for boosting the input direct-current voltage to a third direct-current voltage; and a voltage-adder circuit for adding the third direct-current voltage to the first direct-current voltage and for outputting the second direct-current voltage.

11. A plasma display unit according to claim 10, wherein said power supplying apparatus further comprises a voltage regulator circuit for inputting the first direct-current voltage and converting the voltage into the input direct-current voltage, and wherein said voltage-booster circuit inputs the input direct-current voltage and converts the voltage into the third direct-current voltage.

12. A power supplying apparatus according to claim 11, wherein the plasma display panel makes a display by performing a write operation including an entire-surface discharge cycle, an erasing discharge cycle and data display cycle for each display frame; and wherein the second direct-current voltage causes a discharge over an entire surface of the plasma display panel in the entire-surface discharge cycle.

13. A power supplying apparatus according to claim 10, wherein the plasma display panel makes a display by performing a write operation including an entire-surface discharge cycle, an erasing discharge cycle and data display cycle for each display frame; and wherein the second direct-current voltage causes a discharge over an entire surface of the plasma display panel in the entire-surface discharge cycle.

14. A power supplying apparatus according to claim 10, wherein said voltage-adder circuit adds said voltage during a discharge cycle in which a discharge is caused over an entire surface of the plasma display panel.

15. A method of converting a direct-current voltage input to a power supplying apparatus for a plasma display panel directly into a higher direct-current voltage and of adding two direct-current voltages, said method comprising the steps of:

1) converting the input direct-current voltage by the steps of (a) connecting a plurality of N capacitors, for converting, in series to each other;

(b) connecting the input direct-current voltage to a positive polarity side of a first capacitor of the N capacitors for converting and connecting the negative polarity side of the first capacitor to ground;

(c) connecting the input direct-current voltage to a positive polarity side of an Mth capacitor of the N capacitors for converting and connecting a negative polarity side of the Mth capacitor to ground;

(d) repeating step (c) for M=2 to N; and (e) outputting a boosted voltage of the positive polarity side of the first capacitor; and 2) adding two direct-current voltages including the steps of (a) connecting the input direct-current voltage to a positive polarity side of a capacitor for adding and connecting a negative polarity side of the capacitor for adding to ground;

(b) connecting the boosted voltage to a negative polarity side of the capacitor for adding; and (c) outputting a voltage of the positive polarity side of the capacitor for adding to the plasma display panel.

16. A method of converting a direct-current voltage input to a power supplying apparatus for a plasma display panel directly into a higher direct-current voltage and of adding two direct-current voltages, said method comprising the steps of:

1) converting the input direct-current voltage by the steps of (a) connecting a plurality of N capacitors, for converting, in series to each other;

(b) connecting the input direct-current voltage to a positive polarity side of a first capacitor of the N capacitors for converting and connecting the negative polarity side of the first capacitor to ground;

(c) connecting the input direct-current voltage to a positive polarity side of an Mth capacitor of the N capacitors for converting and connecting a negative polarity side of the Mth capacitor to ground;

(d) repeating step (c) for M=2 to N; and (e) connecting the input direct-current voltage to a negative polarity side of an Nth capacitor of the N capacitors; and (f) outputting a boosted voltage of the positive polarity side of the first capacitor; and 2) adding two direct-current voltages including the steps of (a) connecting the input direct-current voltage to a positive polarity side of a capacitor for adding and connecting a negative polarity side of the capacitor for adding to ground;

(b) connecting the boosted voltage to a negative polarity side of the capacitor for adding; and (c) outputting a voltage of the positive polarity side of the capacitor for adding to the plasma display panel.

17. A power supplying apparatus which inputs a first direct-current voltage for sustaining a discharge in a plasma display panel and which outputs a second direct-current voltage for starting discharge in the plasma display panel, said power supplying apparatus comprising:

a voltage-adder circuit for adding the first direct-current voltage to a third direct-current voltage which is a different voltage from the first direct-current voltage and for outputting the second direct-current voltage.

18. A power supplying apparatus which inputs a first direct-current voltage for sustaining a discharge in a plasma display panel, which generates a second direct-current voltage by adding the first direct-current voltage to a third direct-current voltage which is a different voltage from the first direct-current voltage, and which outputs the second direct-current voltage for starting discharge in the plasma display panel, said power supplying apparatus comprising:

a capacitor having first and second terminals, for outputting the second direct-current voltage;

a diode for supplying the first direct-current voltage to the first terminal of said capacitor;

a first switching device for switching on and off the third direct-current voltage to the second terminal of said capacitor; and a second switching device for switching on and off a connection between the second terminal of said capacitor and a power supply whose voltage level is lower than the third direct-current voltage.

19. A plasma display unit having a plasma display panel and a power supplying apparatus which inputs a first direct-current voltage for sustaining a discharge in the plasma display panel, which generates a second direct-current voltage by adding the first direct-current voltage to a third direct-current voltage which is a different voltage from the first direct-current voltage and which outputs the second direct-current voltage for starting discharge in the plasma display panel, said power supplying apparatus comprising:

a capacitor having first and second terminals, for outputting the second direct-current voltage;

a diode for supplying the first direct-current voltage to the first terminal of said capacitor;

a first switching device for switching on and off the third direct-current voltage to the second terminal of said capacitor; and a second switching device for switching on and off a connection between the second terminal of said capacitor and a power supply whose voltage level is lower than the third direct-current voltage.

20. A power supplying apparatus which inputs a first direct-current voltage for sustaining a discharge in a plasma display panel and which outputs a second direct-current voltage for starting discharge in the plasma display panel, said power supplying apparatus comprising:

a voltage-adder circuit for generating the voltage for starting discharge by adding the voltage for sustaining a discharge to a third direct-current voltage, wherein the third direct-current voltage is a different voltage from the voltage for sustaining a discharge and said voltage-adder circuit for outputting the voltage for starting discharge.

21. A power supplying apparatus a) which inputs a first direct-current voltage for sustaining a discharge in a plasma display panel, b) which generates a second direct-current voltage by adding the first direct-current voltage to a third direct-current voltage, said third-direct current voltage is a different voltage from the first direct-current voltage, and c) which outputs the second direct-current voltage for starting discharge in the plasma display panel, said power supplying apparatus comprising:

a capacitor having first and second terminals, for outputting the voltage for starting discharge;

a diode for supplying the voltage for sustaining the discharge to the first terminal of said capacitor;

a first switching device for switching on and off the third direct-current voltage to the second terminal of said capacitor; and a second switching device for switching on and off a connection between the second terminal of said capacitor and a power supply whose voltage level is lower than the third direct-current voltage.

22. A plasma display unit having a plasma display panel and a power supplying apparatus a) which inputs a first direct-current voltage for sustaining a discharge in the plasma display panel, b) which generates a second direct-current voltage by adding the first direct-current voltage to a third direct-current voltage, said third direct-current voltage is a different voltage from the first direct-current voltage and c) which outputs the second direct-current voltage for starting discharge in the plasma display panel, said power supplying apparatus comprising:

a capacitor having first and second terminals, for outputting the voltage for starting discharge;

a diode for supplying the voltage for sustaining the discharge to the first terminal of said capacitor;

a first switching device for switching on and off the third direct-current voltage to the second terminal of said capacitor; and a second switching device for switching on and off a connection between the second terminal of said capacitor and a power supply whose voltage level is lower than the third direct-current voltage.

* * * * *